US007770865B2

(12) United States Patent
Shaffer

(10) Patent No.: US 7,770,865 B2
(45) Date of Patent: Aug. 10, 2010

(54) HANG LEVEL SUSPENSION SYSTEM

(76) Inventor: Perry Shaffer, 1212 Bidwell St., Apt. 16, Folsom, CA (US) 95630

( * ) Notice: Subject to any disclaimer, the term of this patent is extended or adjusted under 35 U.S.C. 154(b) by 886 days.

(21) Appl. No.: 11/091,670

(22) Filed: Mar. 28, 2005

(65) Prior Publication Data

US 2005/0246930 A1 Nov. 10, 2005

Related U.S. Application Data

(60) Provisional application No. 60/557,753, filed on Mar. 31, 2004.

(51) Int. Cl.
*A47G 1/16* (2006.01)

(52) U.S. Cl. ..... 248/498; 248/489; 248/497

(58) Field of Classification Search ..... 248/489, 248/490, 497, 498, 339
See application file for complete search history.

(56) References Cited

U.S. PATENT DOCUMENTS 383,873 A * 6/1888 Fay ..... 248/495
394,144 A * 12/1888 Sword ..... 248/496
3,384,987 A * 5/1968 Prechtl ..... 40/757
4,244,549 A * 1/1981 Oldfield ..... 248/494
5,437,429 A * 8/1995 Atlas ..... 248/493
5,848,708 A * 12/1998 Edwards ..... 211/17
6,318,698 B1 * 11/2001 Hansen ..... 248/495
2002/0092959 A1 * 7/2002 Szarata ..... 248/489

* cited by examiner

*Primary Examiner*—J. Allen Shriver, II
*Assistant Examiner*—Bradley H Duckworth
(74) *Attorney, Agent, or Firm*—Heisler & Associates

(57) ABSTRACT

A Hang Level Suspension System, hereafter known as Suspension System, for articles such as frames for pictures, mirrors, or other articles to be supported on a wall in a level attitude. The Suspension System for the frame includes two wall hangers, which are attached to a wall in a level attitude, two suspension elements comprising two washers, two equal lengths of chain and two eye-screws. These two suspension elements are mounted, one on each side of the frame, at a precise distance from the top of the frame. Two hangers are spaced apart, on the wall in a level attitude, the same distance as the suspension elements attached to the back of the frame. When the Suspension System is completed, a washer of the Suspension System is placed on the corresponding wall hanger on the wall. The suspended article will hang level at all times.

1 Claim, 6 Drawing Sheets

HANG LEVEL SUSPENSION SYSTEM

CROSS-REFERENCE TO RELATED APPLICATIONS

This application claims benefit under Title 35, United States Code §119(e) of U.S. Provisional Application No. 60/557,753 filed on Mar. 31, 2004.

FIELD OF INVENTION

This invention is directed to a suspension system for hanging of pictures, mirrors, or other articles on a wall in a level orientation.

DESCRIPTION OF PRIOR ART

Usually, a device to hang a picture frame on a wall consists of a loop of wire attached to the back of the frame with two eye screws plus a wall mounted hanger. The loop of wire is placed over the wall hanger projection and the frame is leveled manually. The problem with this support system is the frame must be manually returned to level each time the article is touched for dusting or cleaning.

U.S. Pat. No. 394,144 by J. B. Sword, discloses a device for hanging pictures with a single washer, a single chain and a single eye screw. This device for hanging pictures does not provide a means for the article to be hung level. In the invention disclosed herein, two wall hangers and two support systems share the support of the article to be hung, hence the article remains level even when displaced laterally. Also, the weight of the article to be hung is approximately equally shared by two elements of the suspension system.

U.S. Pat. No. 3,384,987 by R. A. Prechtl, discloses a device for hanging pictures with a single wire attached to the sides of a picture frame by two eye screws and hung off the wall by a single wall hanger. In addition, there are four dowels, with pads that are attached to the edges of the picture frame. These dowels keep the picture parallel to the wall. This design is not similar to the proposed patent application and does not keep the picture level.

U.S. Pat. No. 4,244,549 by C. T. Oldfield, discloses a wall hanging device which has a rectangular plate with three, equally spaced holes on a horizontal centerline. A loop of wire is threaded through the outer holes and the ends of the wire are attached to the frame. A wall support nail through the center hole supports the plate and frame assembly. After initially leveling the frame, friction maintains the frame in a level attitude. However, if the frame is tilted, friction will maintain the tilted attitude.

U.S. Pat. No. 5,437,429 by J. Atlas, discloses a picture hook hanger, is comprised of a wall anchored retention member and an object holding member. The wall-anchored member comprises means for permitting the fixed position anchoring thereof to a wall with a nail. The object holding member comprises means for holding objects thereon, preferably with two hook elements and a means for permitting floating engagement with the nail. Draping the wire on the back of the frame over the hooks and adjusting the picture to level completes the installation. A problem with this design is that the friction of the wire on the hooks is the force that holds the picture level. If the picture is moved, the center of gravity of the frame may be such that the picture does not hang level.

U.S. Pat. No. 5,848,708 by J. L. Edwards, discloses a device for hanging a bicycle from the ceiling. This design is not designed to hang pictures.

U.S. Pat. No. 6,318,698 B1 by C. Hansen, discloses a suspension device comprising a base element which is fastened to the backside of a picture frame, an elongated element and a positioning structure for adjustable positioning of the elongated element relative to the base element. Normally, two suspension devices are used per frame. The emphasis of the Hansen invention is on the structure for adjustment of the elongated element. No description of the wall support member is provided. Also, no description of the complete support system is shown in the nine figures.

U.S. Patent No. US 2002/0092959 A1 by Matthias Szarata, discloses a device for hanging pictures with a holding mechanism attached to the back of the picture frame. The holding mechanism has a hole for a mounting screw plus a clamping device in which a simple hanging cord is inserted. The holding mechanism is attached to the back and top outer edge of the frame. The hanging cord is exposed and the wall hanger is attached to the wall some where above the picture. This device is not similar to the proposed patent application device.

The current invention overcomes the shortcomings of the above disclosures.

The following is a list of items called out on FIGS. 1 through 13;

1. (105)—suspension element;
2. (106)—alternate suspension element;
3. (110)—washer;
4. (111)—chain;
5. (112)—eye-screw;
6. (113)—wall hanger;
7. (114)—nail;
8. (115)—frame;
9. (115B)—frame back;
10. (115F)—frame front;
11. (116)—wall;
12. (117)—cable
13. (118)—heavy-duty frame hanger.

DETAILED DESCRIPTION OF PREFERRED EMBODIMENTS OF THE INVENTION

Figure 1:
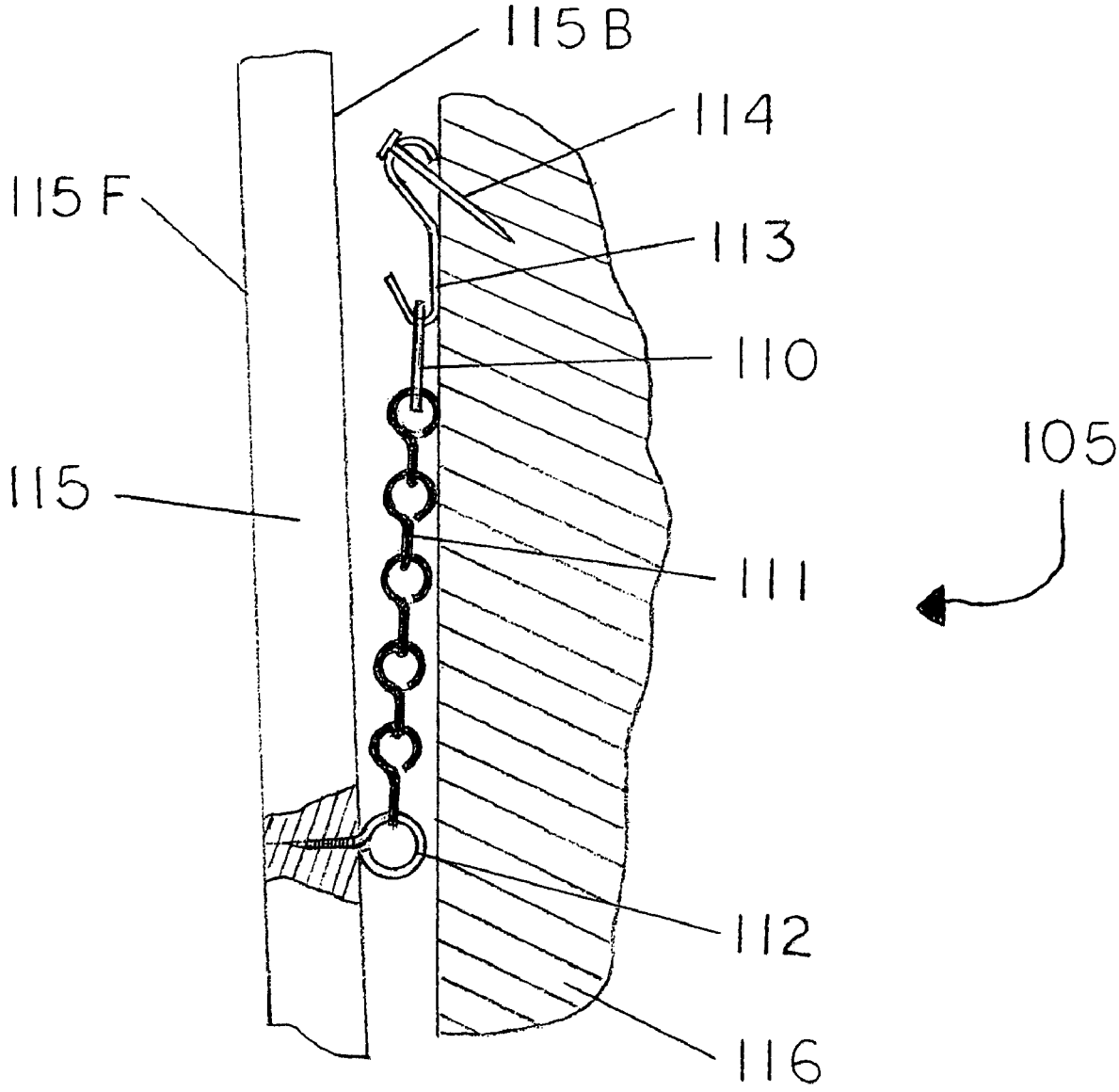
FIG. 1 shows a front view of a frame attached to a wall with two cut away views showing two suspension elements and two wall hangers.
Figure 2:
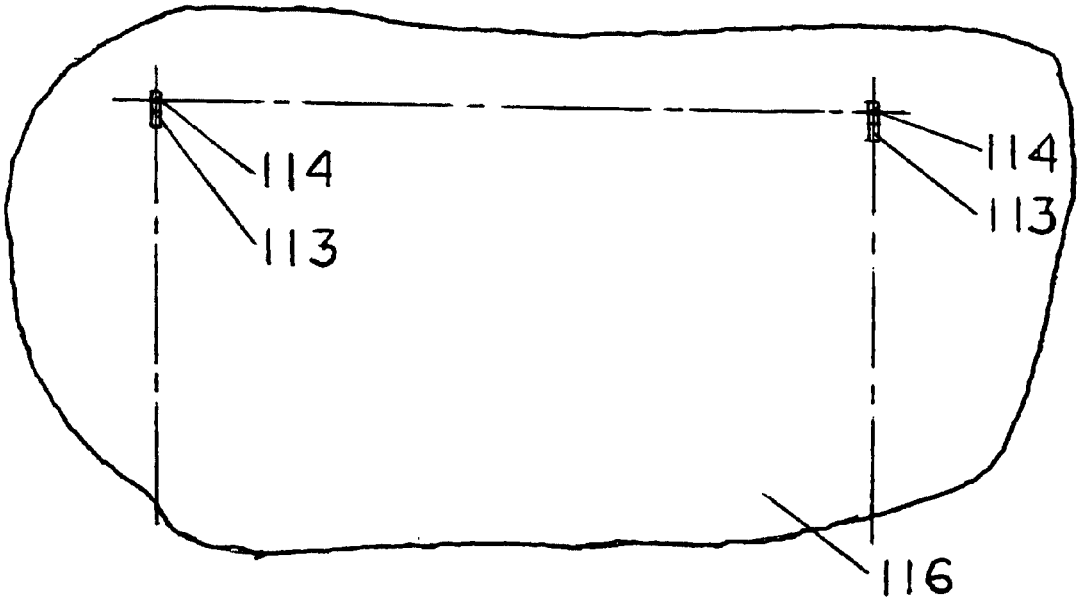
FIG. 2 shows two suspension elements attached to the back of a frame.
Figure 3:
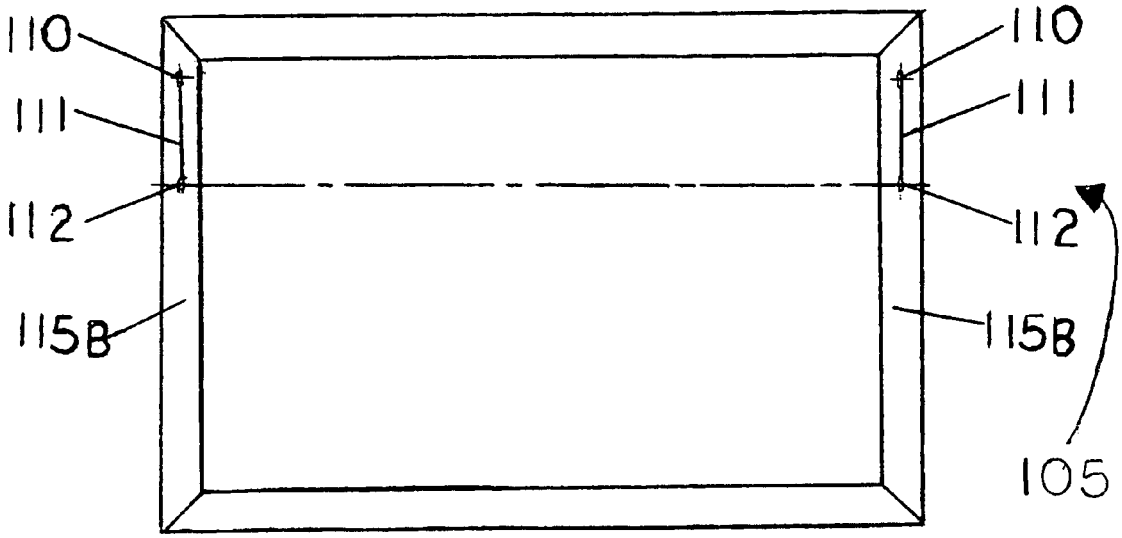
FIG. 3 shows two wall hangers attached to a wall.
Figure 4:
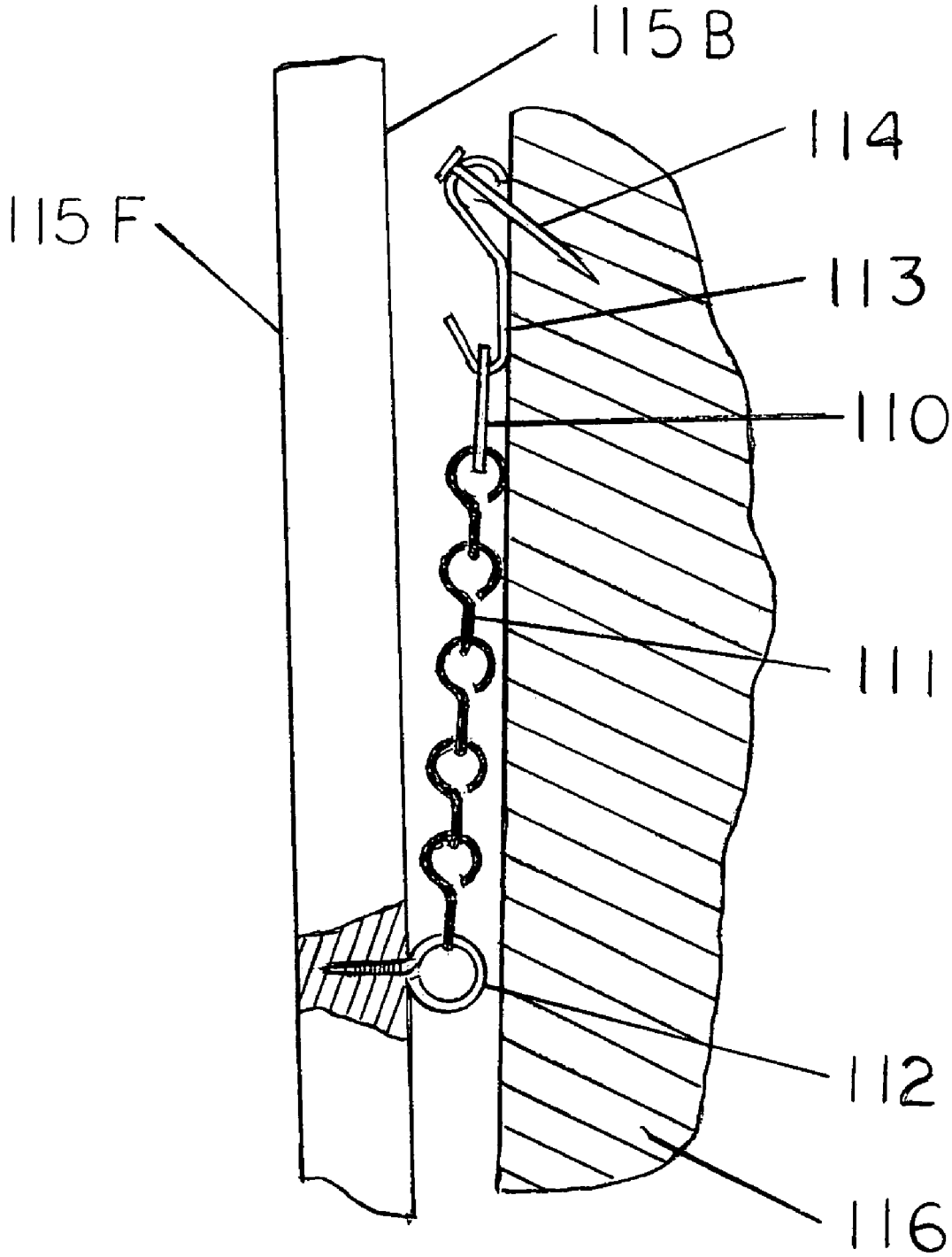
FIG. 4 shows a side view of one-half of a suspension system.
Figure 5:
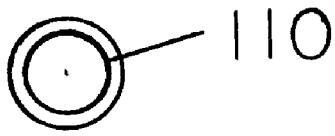
FIG. 5 washer.
Figure 6:
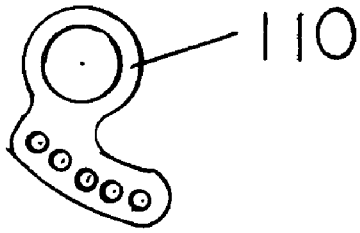
FIG. 6 washer.
Figure 7:
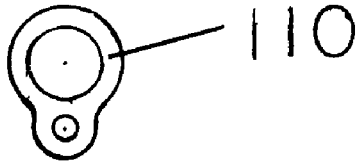
FIG. 7 washer.
Figure 8:
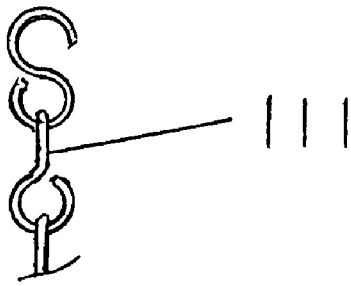
FIG. 8 chain.
Figure 9A:
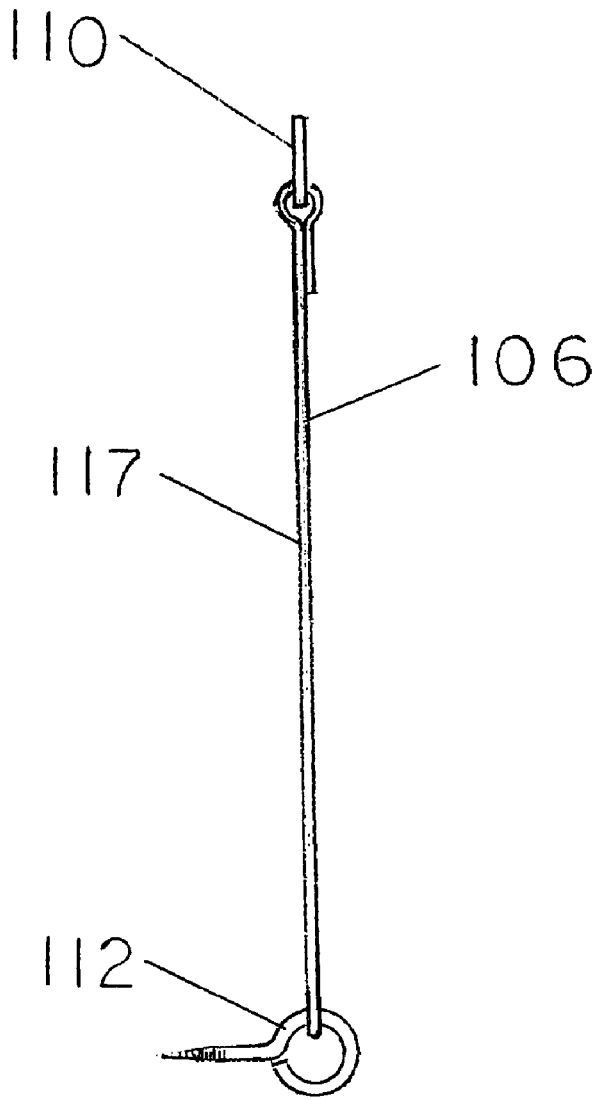
FIG. 9A and FIG. 9B are side and rear elevation views of an alternative support element (106) using a cable (117) instead of a chain (111).
Figure 9B:
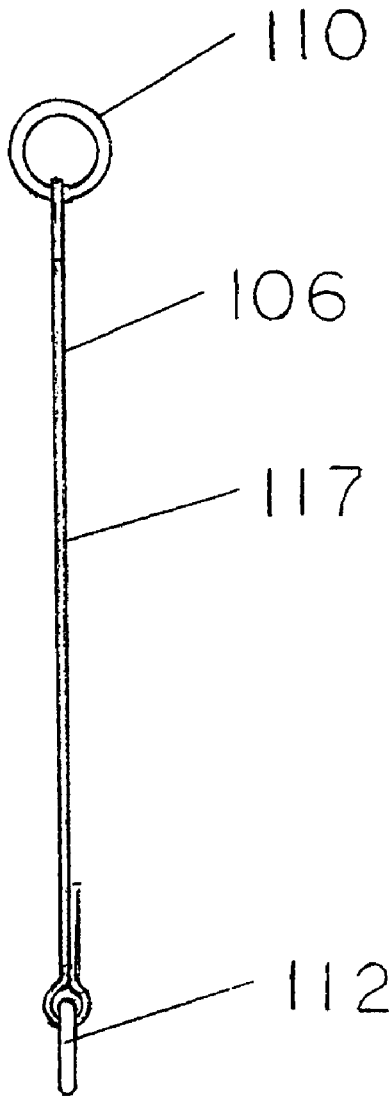
Figure 10:
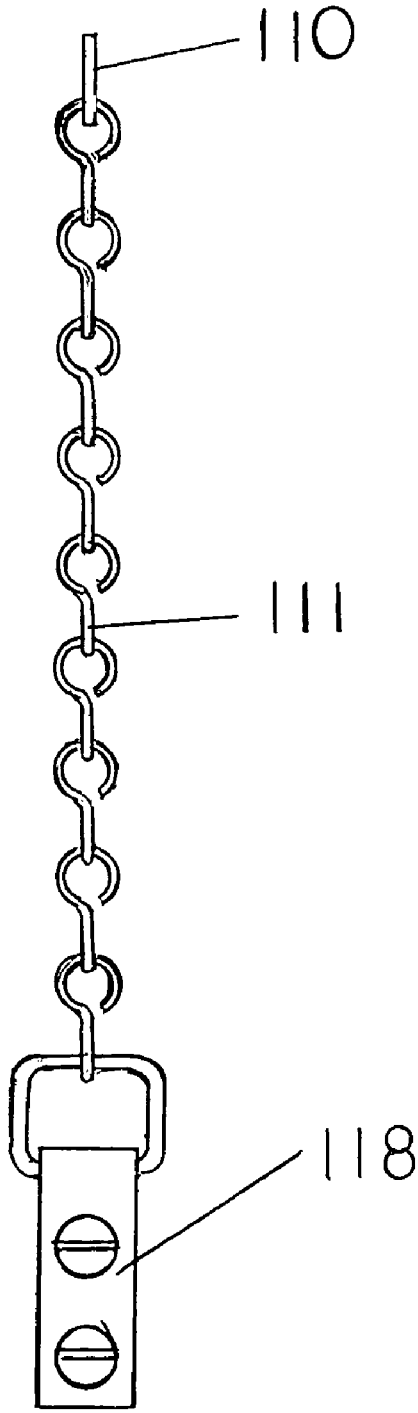
FIG. 10 shows a heavy-duty suspension element, which should be used for hanging heavy articles.

FIG. 1 shows a preferred embodiment of the invention named Hang Level Suspension System. This Suspension System embodies two wall hangers (113) hung approximately level on a wall (116) by two nails (114) at approximately the same distance as the suspension elements (105) attached to the back of the frame (115B) at equal distance from the top of the frame (105).

When the two washers (110) of the two suspension elements (105) are mounted on the two wall hangers (113), which are attached to a wall (116), the frame (115) will hang level. The frame (115), when touched accidentally, or dusted will remain level.

The invention claimed is:

1. A picture frame wall suspension system consisting of:

a first suspension element consisting of an item fastener in the form of an eye screw, the eye screw having an eye portion and a threaded portion, a flexible elongate line affixed directly to the eye portion of the eye screw at one end thereof, a hook connector coupled to the flexible elongate line at an end thereof opposite said eye screw, said hook connector in the form of a washer;

a second suspension element consisting of an item fastener in the form of an eye screw, the eye screw having an eye portion and a threaded portion, a flexible elongate line affixed directly to the eye portion of the eye screw at one end thereof, a hook connector coupled to the flexible elongate line at an end thereof opposite said eye screw, said hook connector in the form of a washer;

said first suspension element and said second suspension element having similar lengths;

said eye screws of each said suspension element adapted to be coupled to a frame at different locations on the frame and at a common elevation on the frame; and a pair of hooks secured to the wall at a substantially common elevation, such that the washers on each of said suspension elements can engage the hooks to suspend the picture frame from the wall.

* * * * *